US007469644B2

(12) United States Patent
Tseng

(10) Patent No.: US 7,469,644 B2
(45) Date of Patent: Dec. 30, 2008

(54) DESK ASSEMBLY

(76) Inventor: Chun-Hsien Tseng, No. 3, Ting-Hsi-Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 346 days.

(21) Appl. No.: 11/338,011

(22) Filed: Jan. 24, 2006

(65) Prior Publication Data

US 2007/0169673 A1 Jul. 26, 2007

(51) Int. Cl.
*A47B 57/00* (2006.01)

(52) U.S. Cl. ..... 108/64; 108/50.01; 108/94; 108/158.11

(58) Field of Classification Search ..... 108/64, 108/69, 91, 92, 93, 94, 50.01, 153.1, 158.11, 108/180; 312/197, 317.2, 317.1, 317.3, 194, 312/223.6, 195
See application file for complete search history.

(56) References Cited

U.S. PATENT DOCUMENTS 260,703 A * 7/1882 Recker ..... 312/239
2,988,413 A * 6/1961 Bergen ..... 312/195
3,392,947 A * 7/1968 Keliehor ..... 108/158.11
4,630,550 A * 12/1986 Weitzman ..... 108/158.11
5,632,540 A * 5/1997 Wilcox ..... 108/94
5,666,887 A * 9/1997 Grabowski et al. ..... 108/91
5,704,298 A * 1/1998 Corpuz et al. ..... 108/50.01
5,842,425 A * 12/1998 van der Aa ..... 108/64
6,161,487 A * 12/2000 Chang ..... 108/50.01
6,170,410 B1 * 1/2001 Gioacchini et al. ..... 108/153.1
6,422,668 B1 * 7/2002 Kelley et al. ..... 312/195
6,497,184 B1 * 12/2002 Whitesitt ..... 108/64
6,997,114 B2 * 2/2006 Chang ..... 108/64
7,178,469 B2 * 2/2007 Goza ..... 108/50.01
2003/0213415 A1 * 11/2003 Ross et al. ..... 108/50.02

* cited by examiner

*Primary Examiner*—José V Chen
(74) *Attorney, Agent, or Firm*—Frommer Lawrence & Haug LLP; Ronald R. Santucci

(57) ABSTRACT

A desk assembly includes a pivot unit, a main desk defining an accommodating space, and an auxiliary desk pivoted to the main desk through the pivot unit and rotatable relative to the main desk between a first position, in which the auxiliary desk is received in the accommodating space, and a second position, in which the auxiliary desk is disposed outwardly of the accommodating space.

5 Claims, 8 Drawing Sheets

DESK ASSEMBLY

BACKGROUND OF THE INVENTION

1. Field of the Invention

This invention relates to a desk assembly, more particularly to a desk assembly that includes a main desk and an auxiliary desk pivoted to the main desk through a pivot unit.

2. Description of the Related Art

Referring to FIG. 1, a conventional desk assembly includes a main desk 11 and an auxiliary desk 13. The main desk 11 includes a main support leg unit 111 and a main desktop 112 mounted on the main support leg unit 111. The main desktop 112 cooperates with the main support leg unit 111 to define a knee space. The auxiliary desk 13 includes an auxiliary support leg unit 132 having two legs, and an auxiliary desktop 131 mounted on the auxiliary support leg unit 132. The auxiliary desk 13 further includes two casters 133 mounted on the legs of the auxiliary support leg unit 132, respectively.

The desk assembly further includes a sliding track assembly 12 having an outer rail 121 mounted on a bottom surface of the main desktop 112 of the main desk 11, and an inner rail 122 mounted on a peripheral edge portion of the auxiliary desktop 131 of the auxiliary desk 13. The inner rail 122 is slidably coupled to the outer rail 121 so as to permit sliding movement of the auxiliary desk 13 into and out of the knee space.

By virtue of the above construction, when the auxiliary desk 13 is not in use, the inner rail 122 can be moved into the outer rail 121 so as to accommodate the auxiliary desk 13 in the knee space. Hence, the space occupied by the desk assembly can be reduced. When the auxiliary desk 13 is in use, the inner rail 122 is moved out of the outer rail 121, and the auxiliary desk 13 extends out of the knee space so as to enlarge the available working area, i.e., the main desktop 112 plus the auxiliary desktop 131.

However, the sliding track assembly 12 generally has a complicated structure involving a plurality of metal elements, which results in a relatively high production cost.

Hence, there is a need in the art to provide a desk assembly having a main desk, and an auxiliary desk capable of being accommodated in and disposed out of the main desk through a simple and inexpensive engagement structure.

SUMMARY OF THE INVENTION

Therefore, the object of the present invention is to provide a desk assembly that can alleviate the aforesaid drawback of the prior art.

According to this invention, a desk assembly includes a pivot unit, a main desk defining an accommodating space, and an auxiliary desk pivoted to the main desk through the pivot unit and rotatable relative to the main desk between a first position, in which the auxiliary desk is received in the accommodating space, and a second position, in which the auxiliary desk is disposed outwardly of the accommodating space.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENTS

Figure 2:
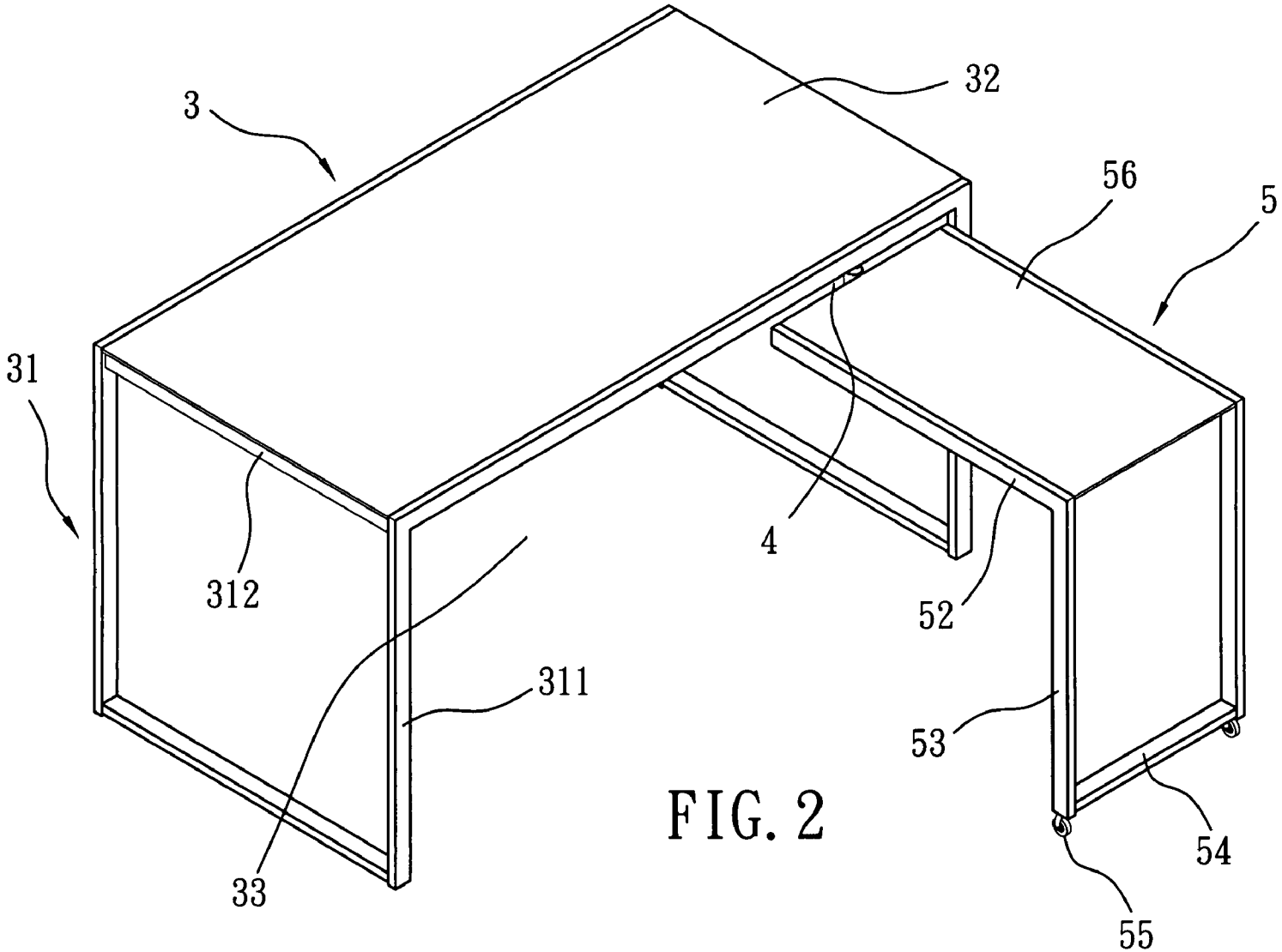
FIG. 2 is a perspective view to illustrate the preferred embodiment of a desk assembly according to the present invention in a use state.
Figure 3:
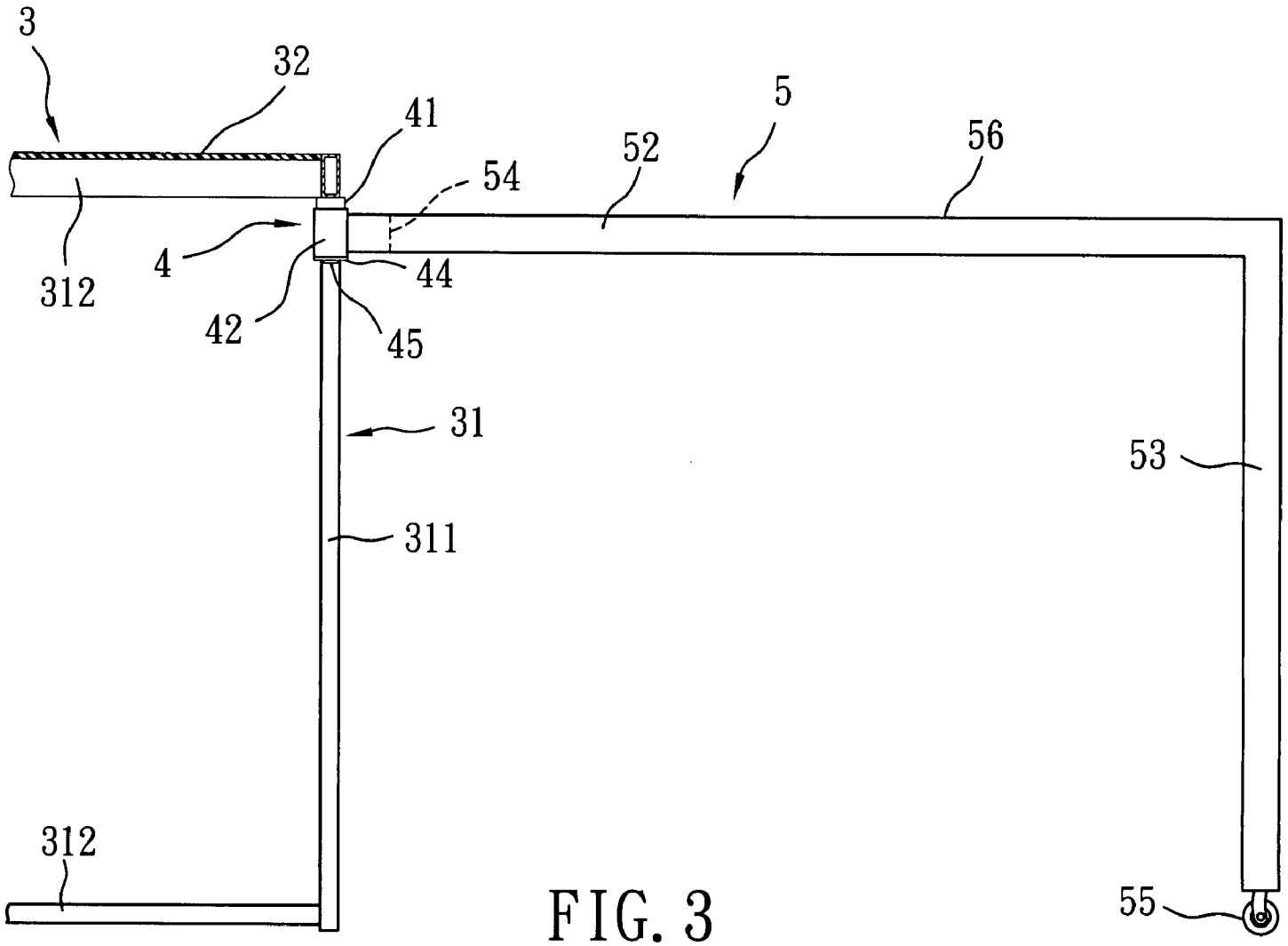
FIG. 3 is a fragmentary partly sectional schematic side view to illustrate the preferred embodiment of FIG. 2.

Referring to FIGS. 2 and 3, the preferred embodiment of a desk assembly according to this invention includes a pivot unit 4, a main desk 3 defining an accommodating space 33, and an auxiliary desk 5 pivoted to the main desk 3 through the pivot unit 4 and rotatable relative to the main desk 3 between a first position, in which the auxiliary desk 5 is received in the accommodating space 33 (see FIGS. 7 and 8), and a second position, in which the auxiliary desk 5 is disposed outwardly of the accommodating space 33 (see FIG. 2).

Figure 4:
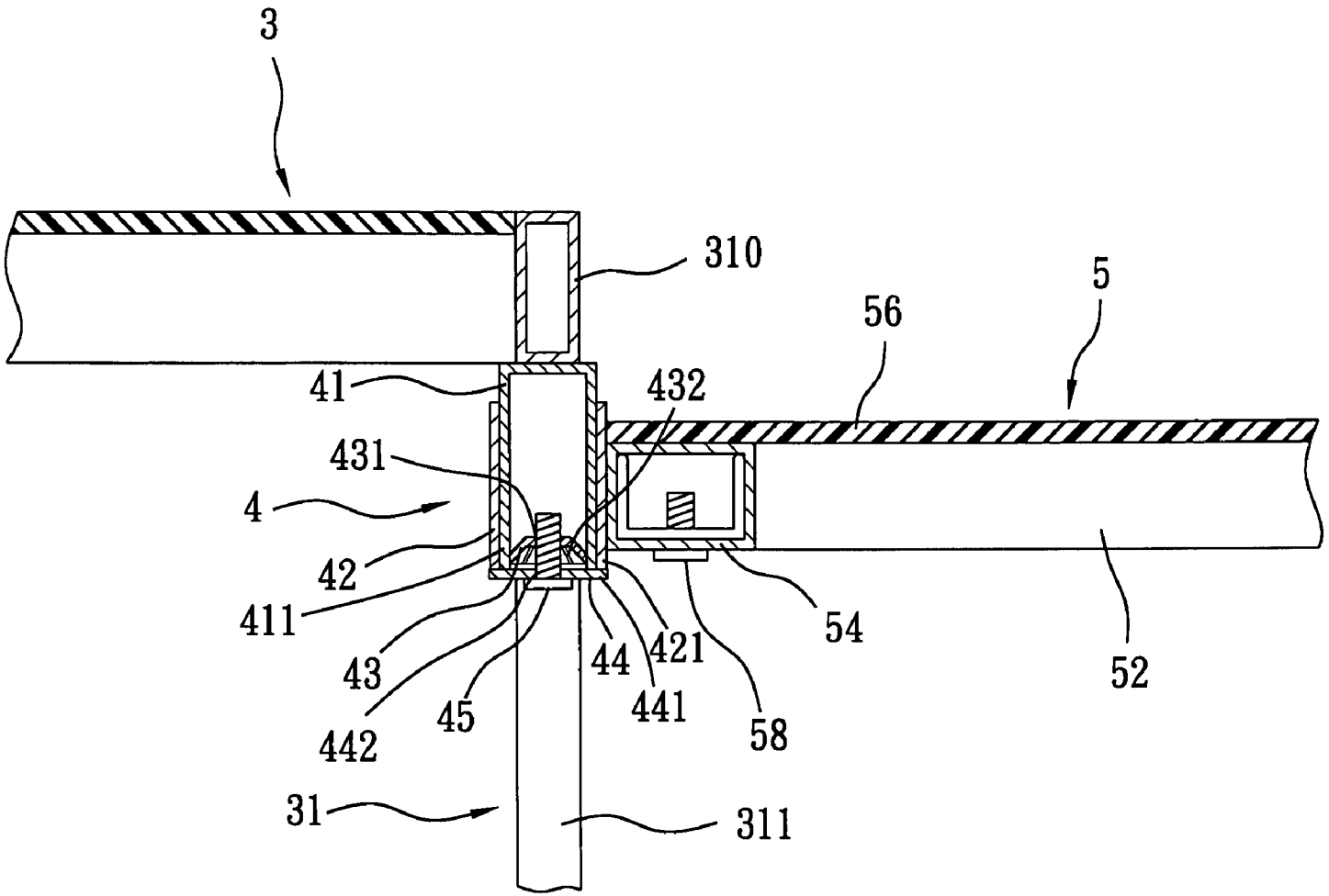
FIG. 4 is a fragmentary sectional view to illustrate a pivot unit of the preferred embodiment of FIG. 2.

With further reference to FIG. 4, the pivot unit 4 includes a tubular part 41 that is fixed to the main desk 3 and that has a bottom end 411, and a sleeve 42 that is fixed to the auxiliary desk 5, that is sleeved rotatably on the tubular part 41, and that has a bottom end 421. The pivot unit 4 further includes a supporting plate 44 that is secured detachably to the bottom end 411 of the tubular part 41 and that has a diameter greater than that of the tubular part 41. The supporting plate 44 has a peripheral edge portion 441 extending outwardly and radially beyond the bottom end 411 of the tubular part 41 and in contact with the bottom end 421 of the sleeve 42 so as to prevent removal of the sleeve 42 from the tubular part 41.

Preferably, the pivot unit 4 further includes a resilient inverted dish 43 mounted securely in the tubular part 41, and a fastener 45 extending through the supporting plate 44 and engaging threadedly the resilient inverted dish 43 so as to fasten the supporting plate 44 to the tubular part 41. More preferably, the supporting plate 44 is formed with a through hole 442, and the resilient inverted dish 43 is formed with a threaded hole 431. The fastener 45 is in the form of a screw, and extends through the through hole 442 in the supporting plate 44 and the threaded hole 431 in the resilient inverted dish 43 so as to fasten the supporting plate 44 to the tubular part 41.

Particularly, prior to mounting of the resilient inverted dish 43 in the tubular part 41 of the pivot unit 4, the resilient inverted dish 43 is in the form of a round disc that has a peripheral edge and that is formed with a plurality of grooves 432 equiangularly displaced and extending inwardly from the peripheral edge towards a center of the round disc. When the round disc is inserted into the tubular part 41, the peripheral edge of the round disc is deformed, thereby forming the inverted dish 43.

Figure 5:
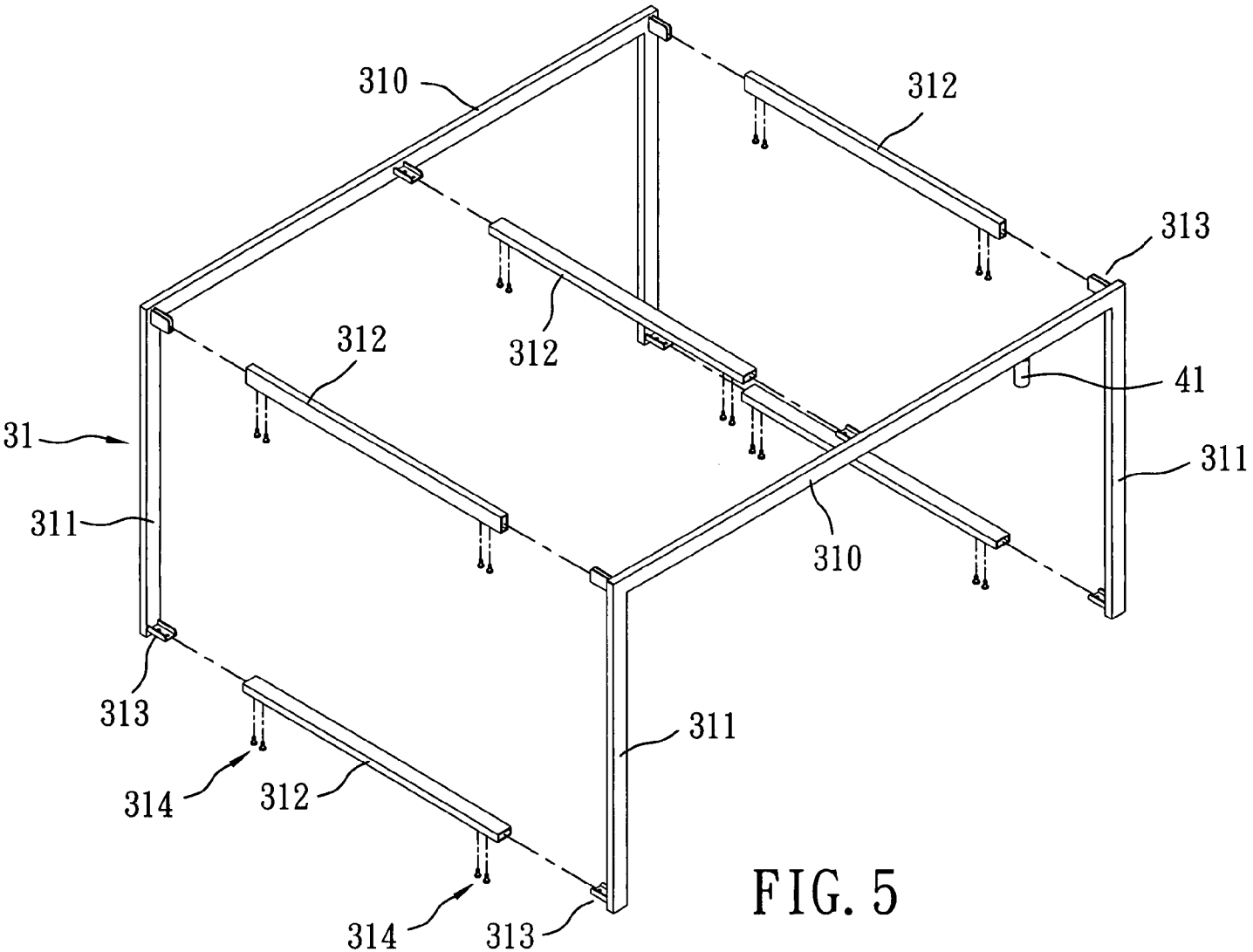
FIG. 5 is an exploded perspective view to illustrate a main desk of the preferred embodiment of FIG. 2.

Referring to FIG. 5, in combination with FIG. 2, the main desk 3 includes two inverted U-shaped support legs 31, a main desktop 32 supported by the two inverted U-shaped support legs 31, and a plurality of hollow stretchers 312 interconnecting the support legs 31. Each of the inverted U-shaped support legs 31 is formed with a crossbar portion 310, two leg portions 311 extending downwardly from the crossbar portion 310, and a plurality of inserts 313 protruding from the crossbar portion 310 and the leg portions 311. Each of the stretchers 312 has two opposite ends that respectively receive and that are fastened to an adjacent pair of the inserts 313 of the inverted U-shaped support legs 31. Preferably, each of the stretchers 312 is fastened to the adjacent pair of the inserts 313 of the inverted U-shaped support legs 31 through screws 314.

In particular, the tubular part 41 of the pivot unit 4 is fixed to the crossbar portion 310 of one of the inverted U-shaped support legs 31.

Figure 6:
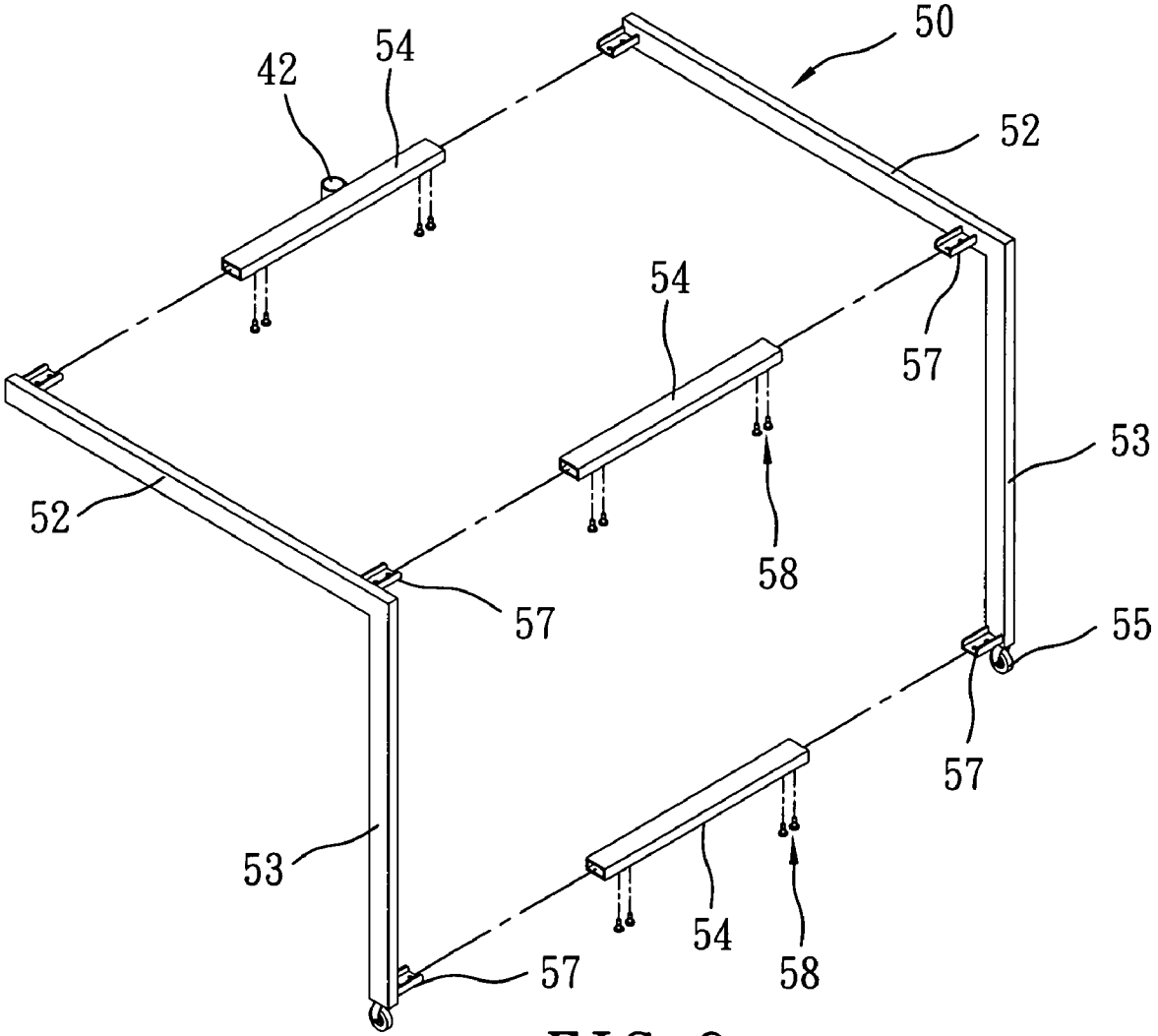
FIG. 6 is an exploded perspective view to illustrate an auxiliary desk of the preferred embodiment of FIG. 2.

Referring to FIG. 6, in combination with FIG. 2, the auxiliary desk 5 includes two inverted L-shaped support legs 50, an auxiliary desktop 56 supported by the two inverted L-shaped support legs 50, and a plurality of hollow stretchers 54 interconnecting the support legs 50. Each of the inverted L-shaped support legs 50 is formed with across bar portion 52, a leg portion 53 extending downwardly from the crossbar portion 52, and a plurality of inserts 57 protruding from the crossbar portion 52 and the leg portion 53. Each of the stretchers 54 has two opposite ends that respectively receive and that are fastened to an adjacent pair of the inserts 57 of the inverted L-shaped support legs 50. Preferably, each of the stretchers 54 is fastened to the adjacent pair of the inserts 57 of the inverted L-shaped support legs 50 through screws 58.

In particular, the sleeve 42 of the pivot unit 4 is fixed to one of the stretchers 54, which is closest to a front end of the main desk 3.

Preferably, the auxiliary desk 5 further includes casters 55 that are respectively provided on the inverted L-shaped support legs 50.

By virtue of the pivot unit 4, as shown in FIG. 2, when the desk assembly is in a use sate, the auxiliary desk 5 is disposed outwardly of the accommodating space 33 of the main desk 3, such that the available working area of the desk assembly is enlarged to the main desktop 32 plus the auxiliary desktop 56.

Figure 7:
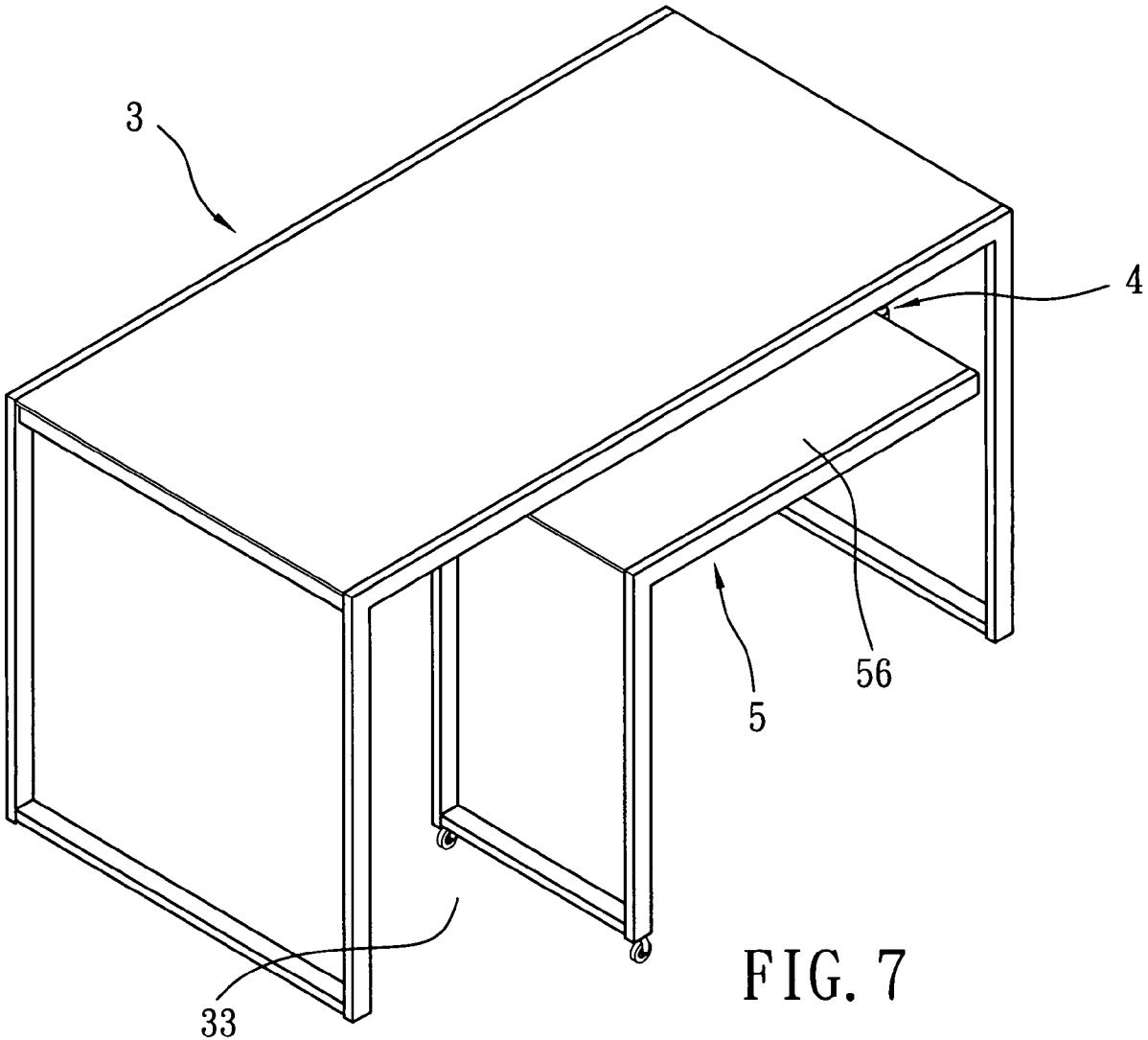
FIG. 7 is a perspective view to illustrate a first state of the preferred embodiment of a desk assembly according to the present invention, where the auxiliary desk is received in the main desk, and where the auxiliary desk is disposed parallel to the main desk.
Figure 8:
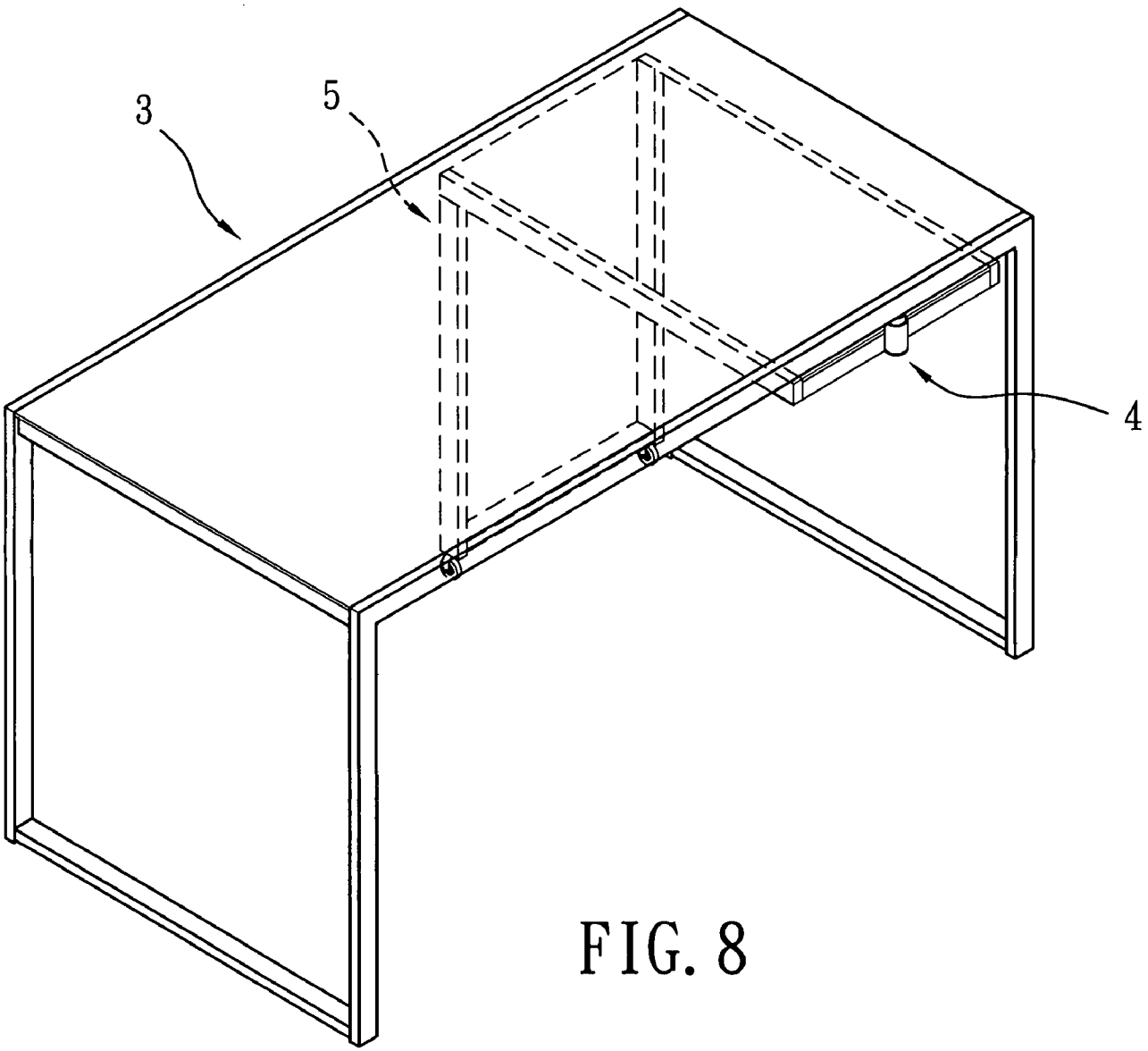
FIG. 8 is a perspective view to illustrate a second state of the preferred embodiment of a desk assembly according to the present invention, where the auxiliary desk is received in the main desk, and where the auxiliary desk is disposed transversely of the main desk.

Referring to FIGS. 7 and 8, when the desk assembly is not in use, the auxiliary desk 5 is received in the accommodating space 33 of the main desk 3. The auxiliary desk 5 can be rotated to a first non-use state, where the auxiliary desk 5 is parallel to the main desk 3 (see FIG. 7), and can be further rotated to a second non-use state, where the auxiliary desk 5 is disposed transversely of the main desk 3. In a non-limiting example, when the desk assembly is used as a computer table, the auxiliary desk 5 can be used as a mobile shelf for accommodating computer peripheral equipments, such as a keyboard or a mouse.

Figure 1:
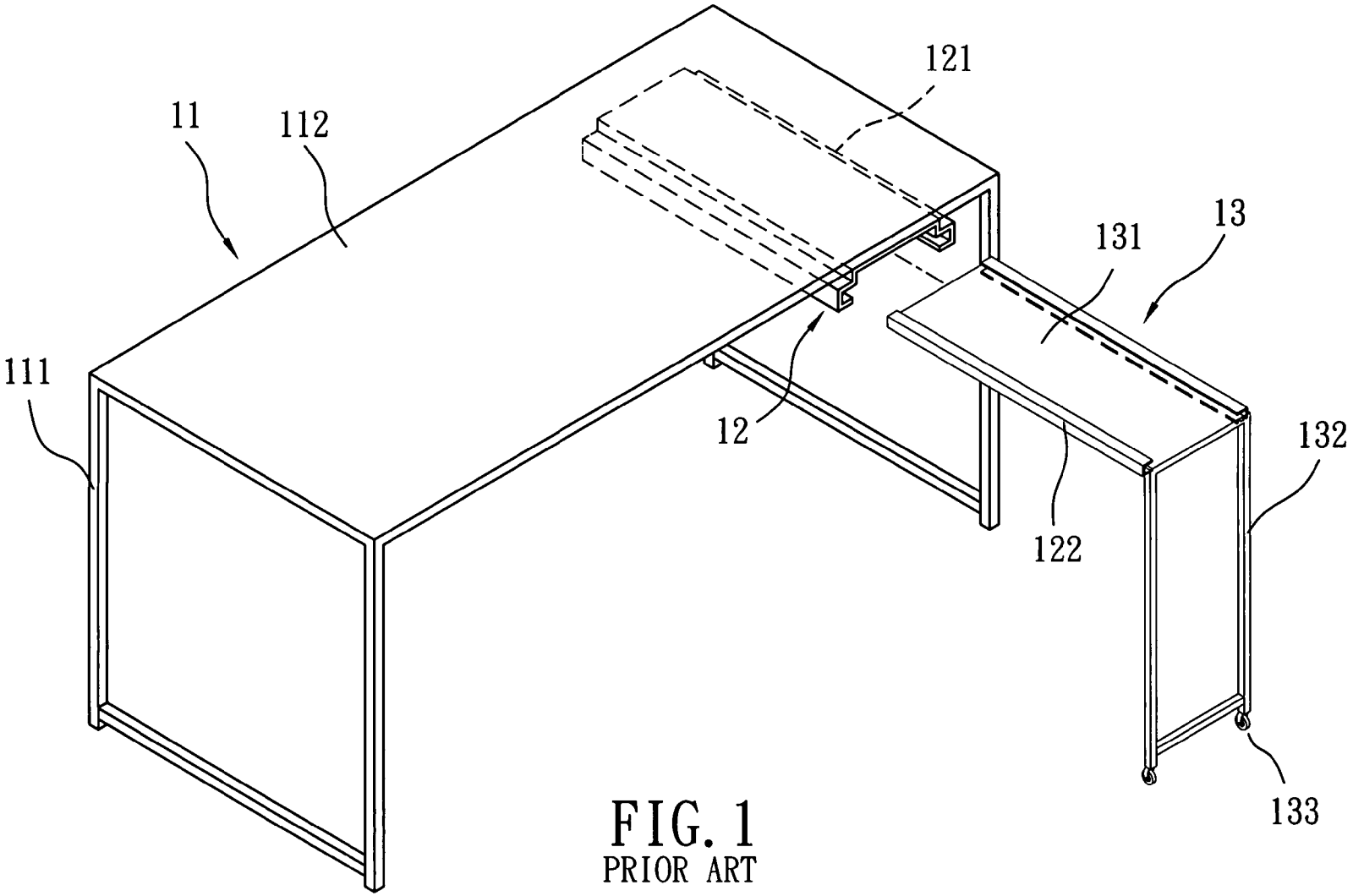
FIG. 1 PRIOR ART
FIG. 1 is a partly exploded perspective view to illustrate a conventional desk assembly.

As compared to the prior art shown in FIG. 1, the desk assembly according to this invention can be adjusted from the state of use (see FIG. 2) to the non-use state (see FIGS. 7 and 8) via a simple pivotal structure, i.e., the pivot unit 4. Moreover, the range of use of the desk assembly can be broadened, and the production cost can be significantly reduced.

In addition, since the screws 314 for fastening the stretchers 312 to the adjacent pair of the inserts 313 of the inverted U-shaped support legs 31 and the screws 58 for fastening the stretchers 54 to the adjacent pair of the inserts 57 of the inverted L-shaped support legs 50 are hidden from plain sight, the appearance of the desk assembly can be enhanced.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A desk assembly comprising:

a pivot unit;

a main desk defining an accommodating space; and an auxiliary desk pivoted to said main desk through said pivot unit and rotatable relative to said main desk between a first position, in which said auxiliary desk is received in said accommodating space, and a second position, in which said auxiliary desk is disposed outwardly of said accommodating space, wherein said pivot unit includes a tubular part fixed to said main desk, and a sleeve fixed to said auxiliary desk and sleeved rotatably on said tubular part; and wherein said tubular part has a bottom end, said sleeve having a bottom end, said pivot unit further including a supporting plate secured detachably to said bottom end of said tubular part, said supporting plate having a peripheral edge portion extending outwardly and radially beyond said bottom end of said tubular part and in contact with said bottom end of said tubular part and in contact with said bottom end of said sleeve so as to prevent removal of said sleeve from said tubular part.

2. The desk assembly of claim 1, wherein said pivot unit further includes a resilient inverted dish mounted securely in said tubular part, and a fastener extending through said supporting plate and engaging threadedly said resilient inverted dish so as to fasten said supporting plate to said tubular part.

3. The desk assembly of claim 1, wherein said main desk includes two inverted U-shaped support legs, and a plurality of hollow stretchers interconnecting said support legs, each of said support legs being formed with a plurality of inserts protruding therefrom, each of said stretchers having two opposite ends that respectively receive and that are fastened to an adjacent pair of said inserts of said support legs.

4. The desk assembly of claim 1, wherein said auxiliary desk includes two inverted L-shaped support legs, and a plurality of hollow stretchers interconnecting said support legs, each of said support legs being formed with a plurality of inserts protruding therefrom, each of said stretchers having two opposite ends that respectively receive and that are fastened to an adjacent pair of said inserts of said support legs.

5. The desk assembly of claim 4, wherein said auxiliary desk further includes casters that are respectively provided on said support legs.

* * * * *